US009816533B2

(12) United States Patent
Falk et al.

(10) Patent No.: US 9,816,533 B2
(45) Date of Patent: Nov. 14, 2017

(54) JET PUMP DATA TOOL SYSTEM

(76) Inventors: Kelvin Falk, Cochrane (CA); Clint Mason, Carstairs (CA)

( * ) Notice: Subject to any disclaimer, the term of this patent is extended or adjusted under 35 U.S.C. 154(b) by 1161 days.

(21) Appl. No.: 13/542,029

(22) Filed: Jul. 5, 2012
(Under 37 CFR 1.47)

(65) Prior Publication Data

US 2013/0084194 A1 Apr. 4, 2013

Related U.S. Application Data

(60) Provisional application No. 61/504,895, filed on Jul. 6, 2011.

(51) Int. Cl.

| | |
|---|---|
| ***F04F 5/48*** | (2006.01) |
| ***E21B 43/12*** | (2006.01) |
| ***E21B 47/18*** | (2012.01) |
| ***F04B 47/00*** | (2006.01) |
| ***F04B 51/00*** | (2006.01) |

(52) U.S. Cl.
CPC ..... *F04F 5/48* (2013.01); *E21B 43/124* (2013.01); *E21B 47/18* (2013.01); *F04B 47/00* (2013.01); *F04B 51/00* (2013.01)

(58) Field of Classification Search
CPC .. F04F 5/48; F04B 47/00; F04B 51/00; E21B 47/18; E21B 43/124; E21B 47/12; E21B 47/0007; E21B 47/26
USPC ..... 417/151; 702/6
See application file for complete search history.

(56) References Cited

U.S. PATENT DOCUMENTS

| | | | |
|---|---|---|---|
| 1,555,232 | A | 9/1925 | Strait |
| 4,280,662 | A | 7/1981 | Erickson |
| 4,441,861 | A | 4/1984 | Canalizo |
| 4,658,893 | A | 4/1987 | Black |
| 4,932,471 | A | 6/1990 | Tucker |
| 5,033,545 | A | 7/1991 | Sudol |
| 5,055,002 | A | 10/1991 | Roeder |
| 5,083,609 | A | 1/1992 | Coleman |

(Continued)

FOREIGN PATENT DOCUMENTS

| | | |
|---|---|---|
| CA | 1179251 | 12/1984 |
| CA | 1325969 | 1/1994 |

(Continued)

OTHER PUBLICATIONS

Yang, "An Integrated Sand Cleanout System by Employing Jet Pumps," JCPT 2009 48(5) 17.

(Continued)

*Primary Examiner* — Essama Omgba
*Assistant Examiner* — Stephen Mick
(74) *Attorney, Agent, or Firm* — Jackson Walker LLP

(57) ABSTRACT

A jet pump, a jet pump data tool system, and method of use thereof. The jet pump includes a body having an intake, a first aperture, and a second aperture between the first aperture and the intake. A carrier is seated in the body and receivable in the first aperture. The carrier includes a venturi for drawing wellbore fluid from the intake into the venturi. A housing for a data tool extends from the carrier. The housing is in fluid communication with the intake for allowing wellbore fluid to be exposed to the data tool. The carrier is seatable in the body by flowing power fluid and the carrier into the first aperture. The carrier is retrievable from the body by flowing power fluid into the second aperture.

14 Claims, 9 Drawing Sheets

(56) References Cited

U.S. PATENT DOCUMENTS

| | | | | |
|---|---|---|---|---|
| 5,355,952 | A | 10/1994 | Meynier | |
| 5,372,190 | A * | 12/1994 | Coleman | F04F 5/10 166/105 |
| 6,167,960 | B1 | 1/2001 | Moya | |
| 6,250,389 | B1 | 6/2001 | Sudol | |
| 6,330,915 | B1 | 12/2001 | Moya | |
| 6,354,371 | B1 * | 3/2002 | O'Blanc | E21B 43/124 166/154 |
| 6,578,631 | B2 | 6/2003 | Milne | |
| 7,048,514 | B2 | 5/2006 | Khomynets | |
| 7,152,683 | B2 | 12/2006 | Khomynets | |
| 7,172,038 | B2 * | 2/2007 | Terry | G01V 3/30 175/320 |
| 7,255,175 | B2 | 8/2007 | Jackson | |
| 7,347,259 | B2 | 3/2008 | Ravensbergen | |
| 7,516,792 | B2 | 4/2009 | Lonnes | |
| 7,537,061 | B2 | 5/2009 | Hall | |
| 7,597,143 | B2 | 10/2009 | Giacomino | |
| 7,690,425 | B2 | 4/2010 | Giacomino | |
| 7,874,359 | B2 | 1/2011 | Bissonnette | |
| 7,896,074 | B2 | 3/2011 | Bissonnette | |
| 7,905,282 | B2 | 3/2011 | Bissonnette | |
| 7,909,089 | B2 | 3/2011 | Jackson | |
| 8,022,838 | B2 | 9/2011 | Murphy | |
| 2004/0134653 | A1 | 7/2004 | Khomynets | |
| 2004/0244993 | A1 | 12/2004 | Crawford | |
| 2007/0187111 | A1 | 8/2007 | Misselbrook | |
| 2008/0314578 | A1 | 12/2008 | Jackson | |
| 2009/0016900 | A1 * | 1/2009 | Khomynets | F04F 5/464 417/172 |
| 2010/0230107 | A1 | 9/2010 | Falk | |
| 2010/0247345 | A1 | 9/2010 | Morris | |
| 2010/0269579 | A1 * | 10/2010 | Lawrence | E21B 47/102 73/152.23 |
| 2011/0067883 | A1 | 3/2011 | Falk | |
| 2012/0134853 | A1 * | 5/2012 | Khomynets | F04F 5/54 417/172 |

FOREIGN PATENT DOCUMENTS

| | | |
|---|---|---|
| CA | 2438877 | 10/2002 |
| CA | 2602964 | 10/2006 |
| CA | 2193923 | 1/2007 |
| CA | 2635526 | 6/2008 |
| CA | 2701954 | 4/2009 |
| CA | 2696517 | 3/2010 |
| GB | 2107397 | 4/1983 |
| WO | WO 94/29571 | 12/1994 |
| WO | WO 2009/049420 | 4/2009 |
| WO | WO 2010/135826 | 12/2010 |

OTHER PUBLICATIONS

International Patent Application No. PCT/CA2012/050455, International Preliminary Report on Patentability dated Jan. 16, 2014.
International Patent Application No. PCT/CA2012/050455, International Search Report and Written Opinion dated Oct. 17, 2012.

* cited by examiner

JET PUMP DATA TOOL SYSTEM

CROSS REFERENCE TO RELATED APPLICATIONS

This application claims the benefit of priority of U.S. Provisional Patent Application No. 61/504,895 filed Jul. 6, 2011, which is incorporated herein by reference in its entirety.

FIELD

The present disclosure relates generally to data acquiring systems for use in a wellbore. More particularly, the present disclosure relates to a data acquiring system for use with a jet pump.

BACKGROUND

Oil well operators and gas well operators often wish to know the resulting downhole pressure and temperature of a well as they remove fluids from the well during production operations. Various forms of recording equipment are available, but the recording equipment may be difficult or expensive to use with production equipment.

Jet pumps are a versatile wellbore pumping system used in oil and gas wells. However, like other production systems, some jet pumps do not allow for use of data recording techniques without significant cost and effort. When recording equipment is used, it may be installed on the end of a jet pump production assembly. The recording equipment may be installed initially with the jet pump or it may be necessary to pull the jet pump and install the recording equipment when data recording is desired. Either way, this approach requires pulling the entire tubing string and jet pump assembly from the well to get the recording equipment in order to review recorded data. This approach typically requires a service rig or a coiled tubing unit.

Another approach requires the jet pump to be installed in a sliding sleeve assembly. This approach requires a wireline service unit, which would have to perform several trips in-hole to retrieve the sleeves with the venturi, the standing valve, and finally the recording equipment. Both the standing valve and the jet pump would then need to be re-run by the wireline unit to put the well back on production.

It is, therefore, desirable to provide a system wherein data relating to downhole conditions may be received and the data accessed without pulling tubing from a well.

SUMMARY

It is an object of the present disclosure to obviate or mitigate at least one disadvantage of previous data recording systems for use with jet pumps.

In a first aspect, the present disclosure provides a system for acquiring data of downhole conditions in a wellbore. The system includes a jet pump body with an intake at a first end for receiving wellbore fluid form the wellbore and an aperture at a second end for receiving a carrier. The carrier includes a venturi nozzle, venturi gap, and mixing tube in series in fluid communication with tubing for delivering power fluid to the venturi nozzle along a first flow path. The carrier may be seated within the jet pump body, wherein flow along the first flow path results in a low-pressure condition at the venturi gap. The low-pressure condition draws the wellbore fluid into the jet pump body at the intake and to the venturi gap. The carrier also includes a data tool housing and a second flow path providing fluid communication between the intake and the housing. During operation of the jet pump to produce wellbore fluid, the first and second flow paths are separated from each other.

In a further aspect, the present disclosure provides a jet pump, a jet pump data tool system, and method of use thereof. The jet pump includes a body having an intake, a first aperture, and a second aperture between the first aperture and the intake. A carrier is seated in the body and receivable in the first aperture. The carrier includes a venturi for drawing wellbore fluid from the intake into the venturi. A housing for a data tool extends from the carrier. The housing is in fluid communication with the intake for allowing wellbore fluid to be exposed to the data tool. The carrier is seatable in the body by flowing power fluid and the carrier into the first aperture. The carrier is retrievable from the body by flowing power fluid into the second aperture.

In a further aspect, the present disclosure provides a jet pump including a body having an uphole end and a downhole end, the body defining an intake proximate the downhole end, a first aperture proximate the uphole end, and a second aperture between the first aperture and the intake, a carrier seated in the body and receivable in the first aperture, the carrier defining a power fluid inlet and a flow path providing fluid communication between the power fluid inlet and the second aperture, a venturi within the flow path, the venturi in fluid communication with the intake, the power fluid inlet, and the second aperture, for drawing wellbore fluid from the intake into the venturi when power fluid flows from the power fluid inlet to the second aperture and through the venturi, an intake channel defined by the body for providing fluid communication between the intake and the venturi, a housing extending from the carrier proximate the uphole end for receiving a data tool, and a data channel defined by the carrier for providing fluid communication between the intake and the housing. The carrier is seatable in the body by flowing power fluid and the carrier into the first aperture. The carrier is retrievable from the body by flowing power fluid into the second aperture.

In an embodiment, the jet pump includes an accelerator shoulder on the carrier for providing a surface against which the power fluid propels the carrier for seating in the body.

In an embodiment, the mixing tube provides a surface against which the power fluid propels the carrier for retrieving the carrier from the body.

In an embodiment, the data channel is in fluid communication with the intake channel. In an embodiment, the data channel branches from the intake channel between the venturi and the first aperture. In an embodiment, the housing extends from the carrier out of the uphole end. In an embodiment, the housing extends into tubing when the jet pump is in fluid communication with the tubing.

In an embodiment, the jet pump further includes a fluid segregation membrane dividing the data channel into a first portion and a second portion, wherein the first portion is in fluid communication with the housing and the second portion is in fluid communication with the intake. In an embodiment, the jet pump further includes data fluid in the first portion and in the housing.

In an embodiment, the jet pump includes a data tool in the housing for acquiring data of downhole conditions. In an embodiment, the data tool includes a memory tool. In an embodiment, the memory tool includes memory for storing data, a processor in operative communication with the memory for causing the data to be stored on the memory, and a power source for providing power to the processor and memory.

In an embodiment, the jet pump includes a data tool in the housing for acquiring data of downhole conditions. In an embodiment, the jet pump includes a wired connection between the data tool and the surface for establishing operative communication between the data tool and the surface. In an embodiment, the data tool includes a real-time data sensing tool.

In a further aspect, the present disclosure provides a method of acquiring data from a wellbore including providing a jet pump in the wellbore, the jet pump in fluid communication with the surface through tubing, and the jet pump comprising a jet pump body and a carrier seated within the jet pump body, the carrier comprising a housing extending into the tubing and a data tool in the housing, flowing power fluid in a first flow path into the jet pump to draw wellbore fluid into the jet pump and produce return fluid at the surface, and acquiring production data from the wellbore fluid with the data tool.

In an embodiment, the method further includes flowing power fluid in a second flow path to retrieve the carrier from the jet pump at the surface. In an embodiment, the method further includes seating the carrier in the jet pump by flowing the carrier into the jet pump through the tubing on a stream of power fluid.

In an embodiment, the method further includes ceasing flow of the power fluid into the jet pump, flowing a low-density fluid into the jet pump to displace power fluid, wellbore fluid, and return fluid from the jet pump and the tubing, ceasing flow of the low-density fluid into the jet pump, allowing wellbore fluid to flow into the housing in the absence of power fluid flow along the first flow path and acquiring shut-in data from the wellbore fluid with the data tool. In an embodiment, the low-density fluid comprises a non-condensible gas. In an embodiment, the non-condensible gas comprises nitrogen.

Other aspects and features of the present disclosure will become apparent to those ordinarily skilled in the art upon review of the following description of specific embodiments in conjunction with the accompanying figures.

BRIEF DESCRIPTION OF THE DRAWINGS

Embodiments of the present disclosure will now be described, by way of example only, with reference to the attached Figures in which like reference numerals refer to like elements.

DETAILED DESCRIPTION

Generally, the present disclosure provides an apparatus, method, and system for installing a data tool into a jet pump located in a wellbore, measuring downhole conditions in the wellbore, and retrieving the data tool from the jet pump. The downhole conditions may be measured while operating the jet pump to produce fluid from the wellbore or while the jet pump is not producing fluid. The data tool can be retrieved from the jet pump without pulling the jet pump or tubing to which the jet pump is attached. The data tool is present on a carrier which is removably seated in the jet pump. The carrier is installed in the jet pump by introducing the carrier into the tubing and flowing power fluid into the tubing. The carrier is retrieved by reversing flow of the power fluid, unseating the carrier from the jet pump and propelling the carrier to the surface through the tubing.

Jet Pump

Figure 1:
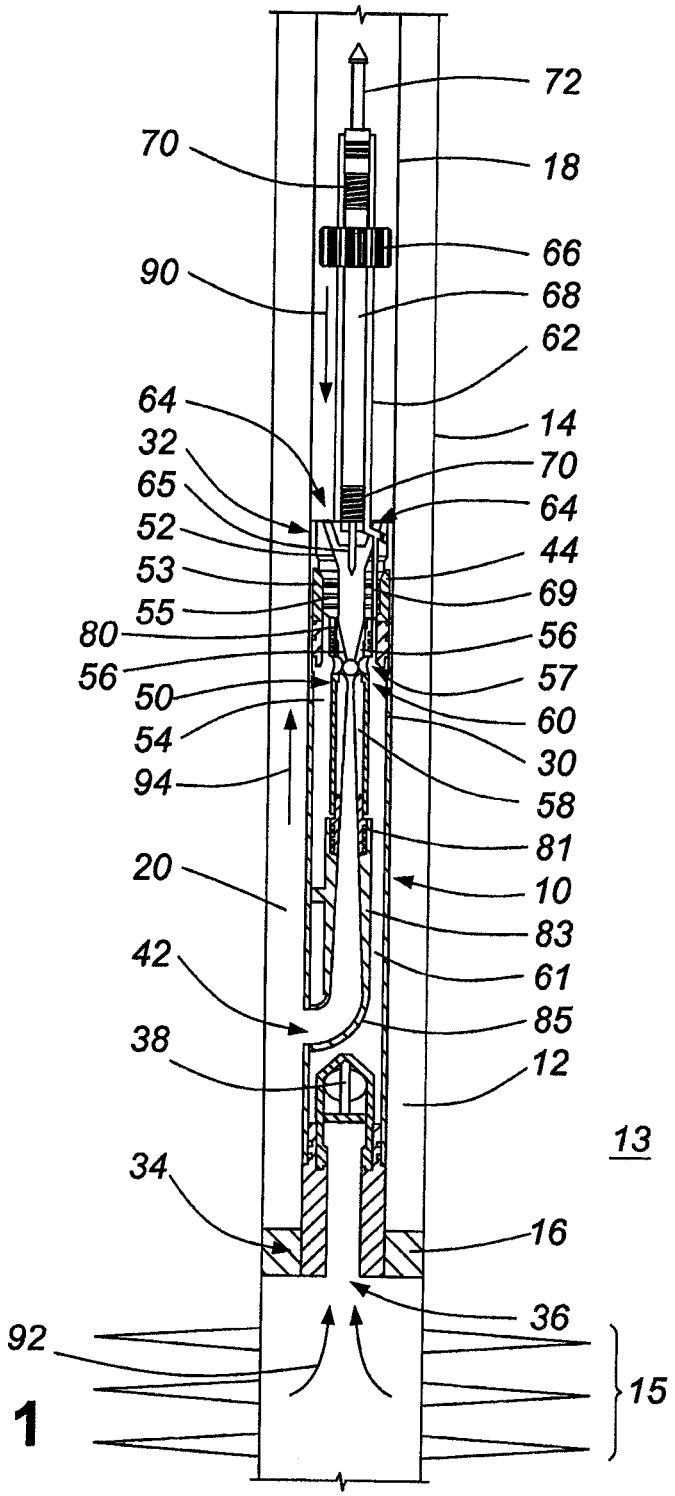
FIG. 1 is a cross-section elevation view of a jet pump with a carrier in a wellbore and producing fluid.

FIG. 1 is cross-section elevation view of a jet pump 10 installed in a wellbore 12 and in operation. The wellbore 12 is in a formation 13 with perforations 15. The wellbore 12 includes a casing 14. The jet pump 10 is secured to the casing 14 by a packer 16. The jet pump 10 is in fluid communication with the surface through tubing 18 and through an annulus 20 defined by the tubing 18 and the casing 14.

The jet pump 10 includes a jet pump body 30 with an uphole end 32 and a downhole end 34. When the jet pump 10 is installed on the tubing 18 in the wellbore 12, the uphole end 32 is uphole of the downhole end 34 in both horizontal and vertical wellbores. An intake 36 in the jet pump body 30 is proximate the downhole end 34. The intake 36 provides fluid communication between the wellbore 12 and the jet pump body 30. The jet pump body 30 may include a standing valve 38. A first aperture 40 (FIG. 5) in the jet pump body 30 is proximate the uphole end 32. A second aperture 42 in the jet pump body 30 is in between the first aperture 40 and the intake 36. The second aperture 42 provides fluid communication between the jet pump body 30 and the annulus 20.

Figure 2:
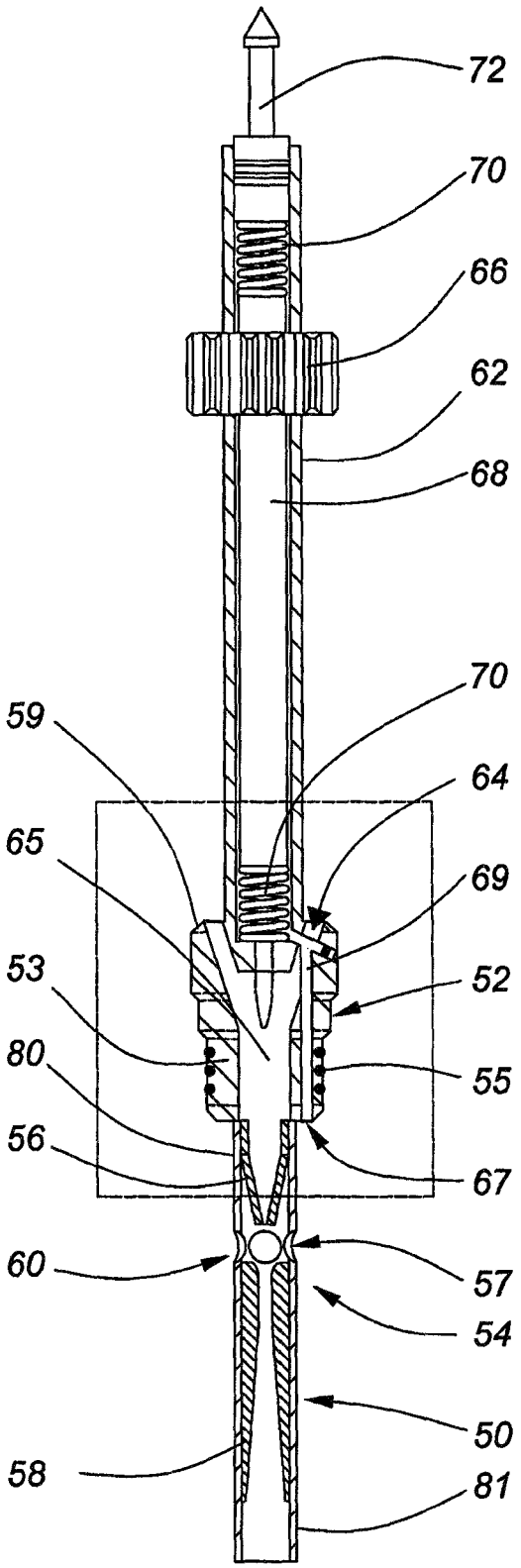
FIG. 2 is a cross-section elevation view of the carrier of FIG. 1.

FIG. 2 is a cross-section elevation view of a carrier 50. In FIG. 1, the carrier 50 is seated in the jet pump body 30. The carrier 50 includes a carrier body 52 for seating within a carrier seat 44 of the jet pump body 30. A seal portion 53 of the carrier body 52 forms a seal with the carrier seat 44 when the carrier body 52 is seated in the carrier seat 44. The carrier 50 includes a venturi 54 with a venturi nozzle 56 and a mixing tube 58 in series. A venturi gap 60 separates the venturi nozzle 56 from the mixing tube 58. The carrier 50 includes ports 57 for providing fluid communication between the intake 36 and the venturi gap 60. An intake channel 61 (FIG. 1) is defined within the jet pump body 30 for providing fluid communication between the intake 36 and the venturi 54.

A housing 62 extends from the carrier body 52. The housing 62 may receive a data tool 68 for acquiring data of downhole conditions. The data may for example include pressure data, temperature data, or both. The data tool 68 is isolated from conditions outside the housing 62, for example pressure and temperature resulting from flow of power fluid 90 in the tubing 18.

Figure 3:
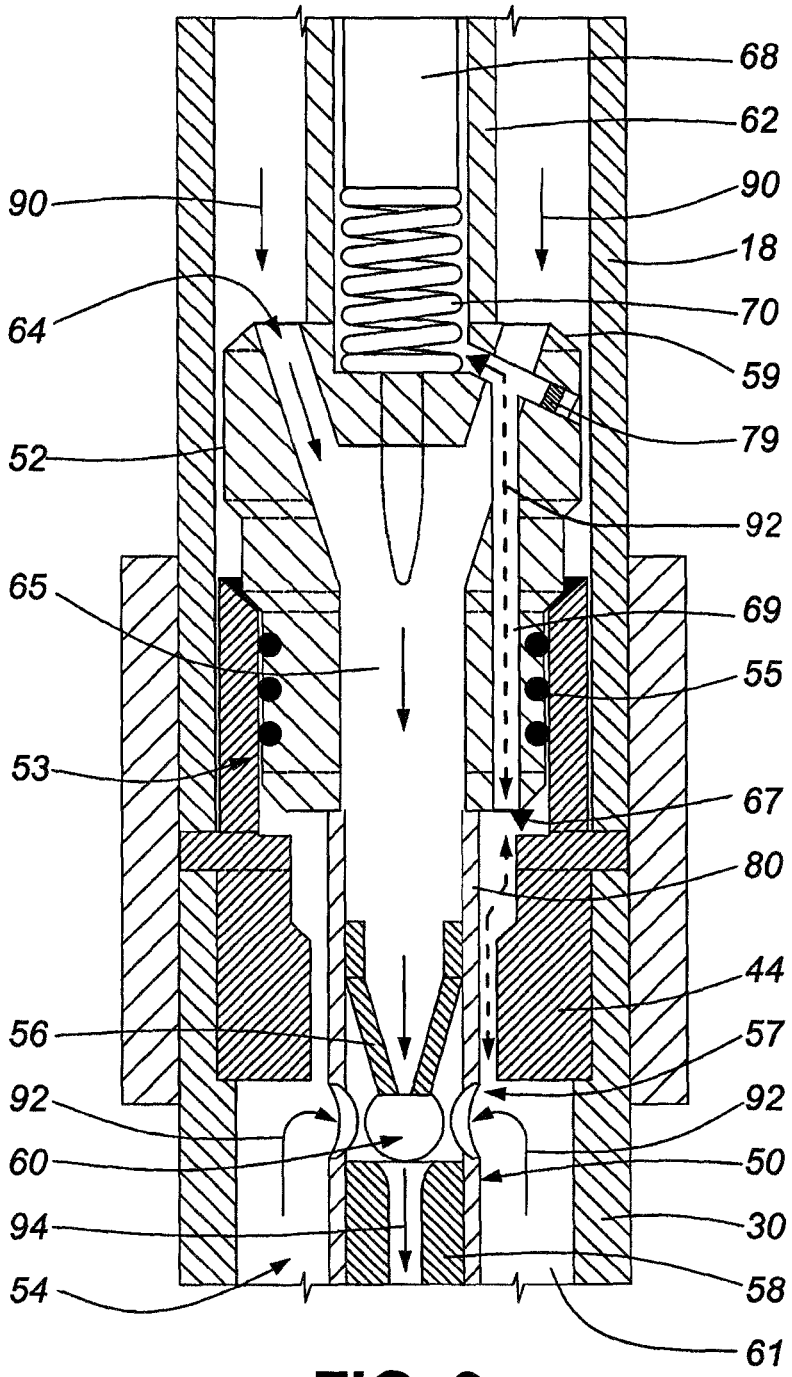
FIG. 3 is a cross-section elevation detail view of the carrier of FIG. 1 installed in a jet pump.

FIG. 3 is a cross-section elevation detail view of the carrier 50 seated in the carrier seat 44 during operation of the jet pump 10. A power fluid inlet 64 in the carrier body 52 provides fluid communication between the tubing 18 and the venturi 54. A power fluid channel 65 extends between the power fluid inlet 64 and the venturi nozzle 56. The power fluid channel 65 and the venturi 54 provide a flow path between the power fluid inlet 64 and the second aperture 42. A data inlet 67 in the carrier body 52 provides fluid communication between the intake 36 and the housing 62. A data channel 69 extends between the data inlet 67 and the housing 62. Through the data channel 69, the data tool 68 may be exposed to downhole conditions by fluid communication with wellbore fluid 92, and receive data of downhole conditions. The power fluid channel 65 and data channel 69 are not in fluid communication within the carrier body 50, allowing exposure of the data tool 68 to the downhole conditions, but not to conditions around the housing 62, for example due to flow of power fluid 90 in the tubing 18.

In an embodiment, the data tool 68 may be a memory tool. The memory tool may include memory for storing data, a processor for causing the data to be stored on the memory, and a power source for providing power to the processor.

In an embodiment, a centralizer 66 may extend radially from the carrier 50, for example at the housing 62. The centralizer 66 may be a fluted centralizer.

Figure 5:
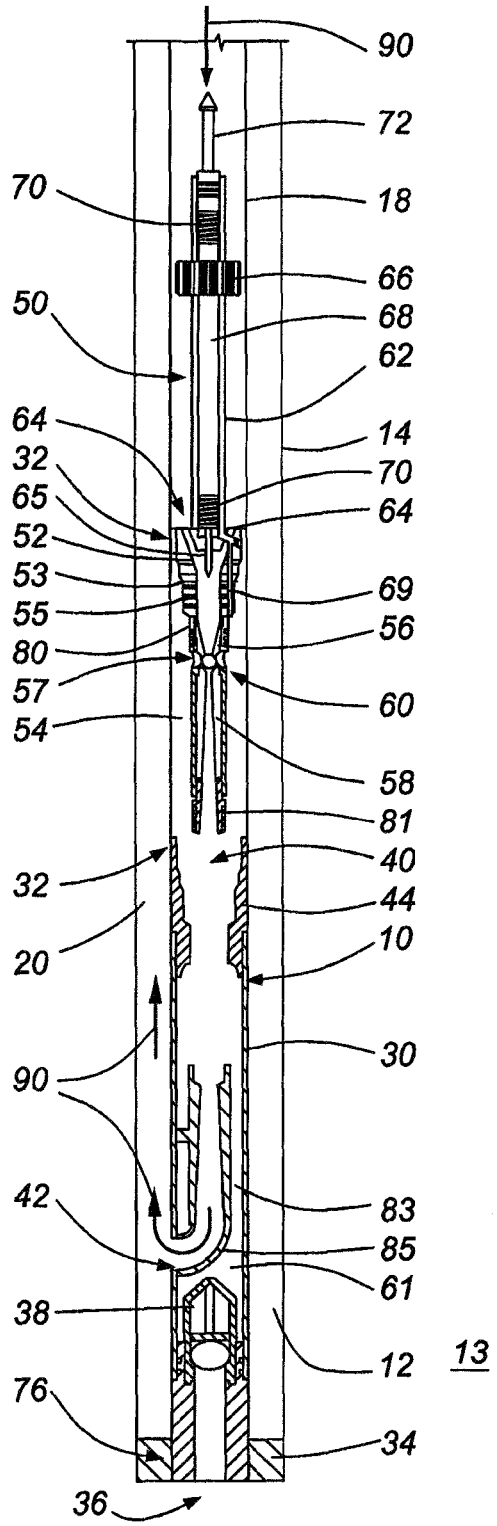
FIG. 5 is a cross-section elevation view of the jet pump of FIG. 1 showing installation of the carrier in the jet pump.
Figure 6:
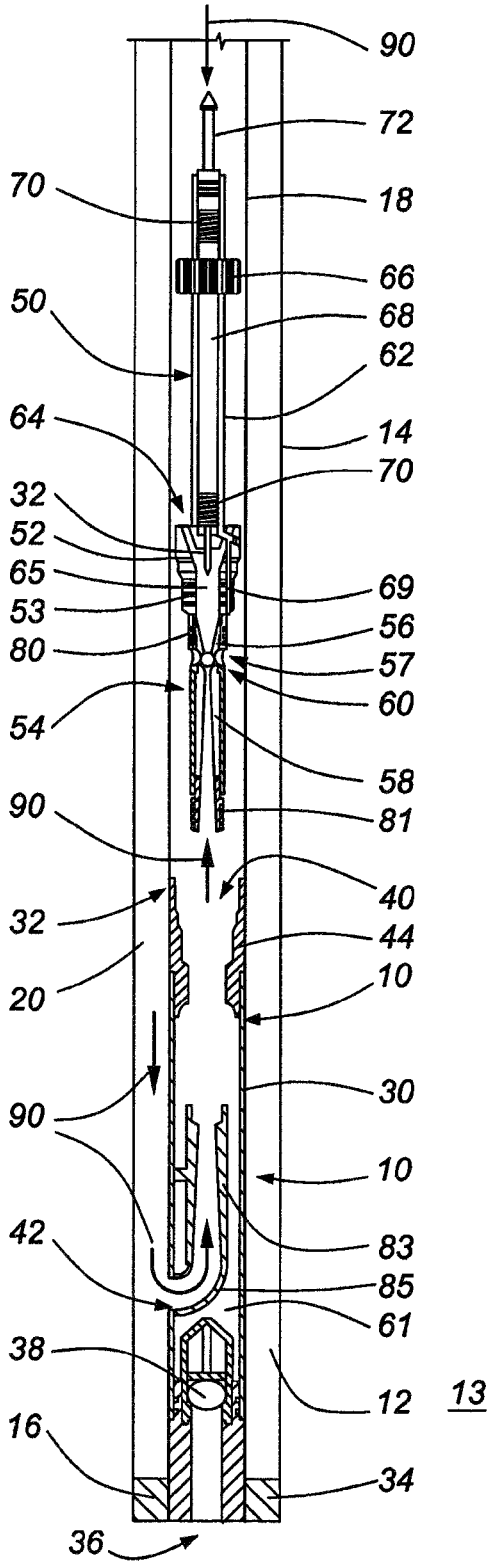
FIG. 6 is a cross-section elevation view of the jet pump of FIG. 1 showing retrieval of the carrier from the jet pump.

In an embodiment, a shock absorber may be present in the housing 62 to cushion the data tool 68 during installation and retrieval of the carrier 50 (FIGS. 5 and 6). The shock absorber may for example be a pair of springs 70.

In an embodiment, a fishing neck 72 may extend from the carrier 50 to facilitate retrieval of the carrier 50 from the tubing 18 at a wellhead. The fishing neck 72 may for example extend from the housing 62.

In an embodiment, the mixing tube 58 may be comprised of a hardened material or include a hardened coating to increase resistance to erosion.

In an embodiment, a removable insert plug 79 is present in the data channel 69 to facilitate servicing and cleaning data channel 69.

In an embodiment, the seal portion 53 may include one or more o-rings 55.

Figure 4:
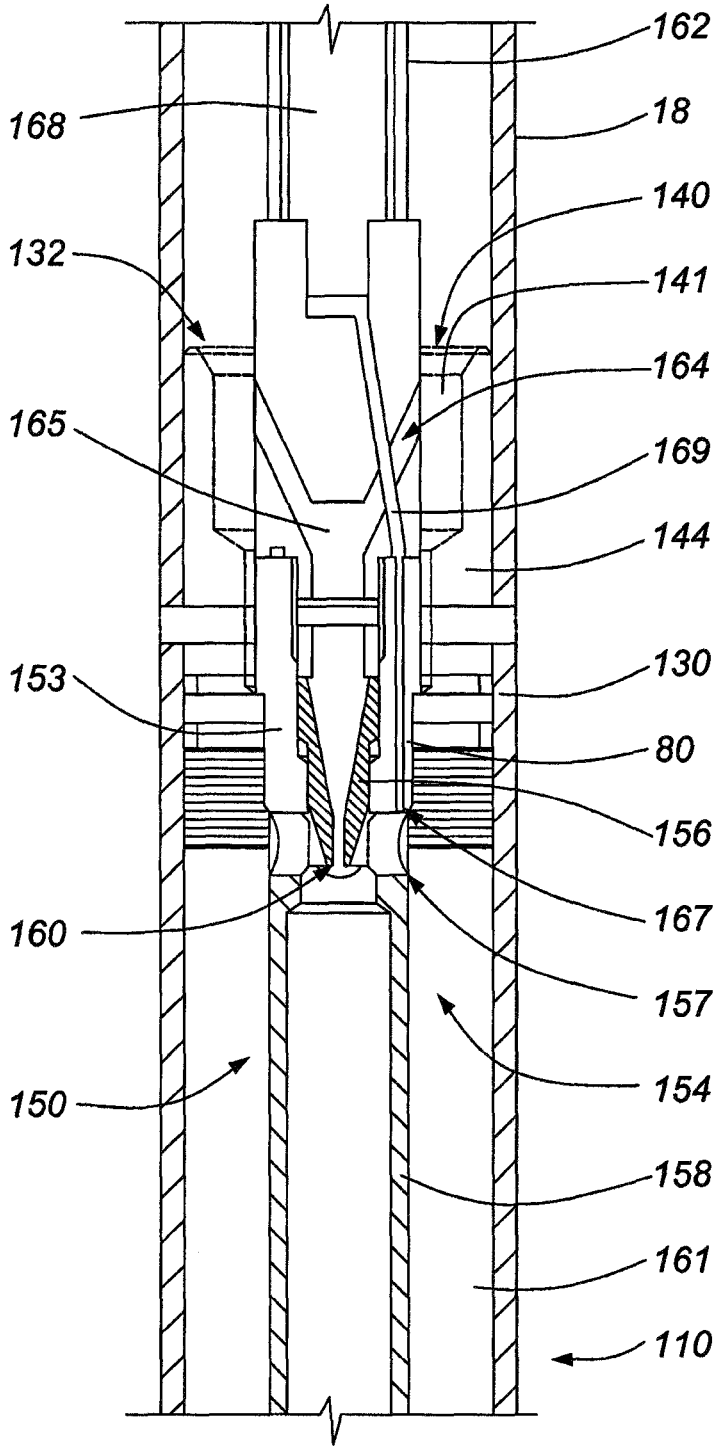
FIG. 4 is a cross-section elevation detail view of a carrier installed in a jet pump.

FIG. 4 is a cross-section elevation detail view of a carrier 150 installed in a jet pump 110. The jet pump 110 includes a jet pump body 130 with an uphole end 132 and a downhole end (similar to the downhole end 34 of the jet pump 10; downhole end of the jet pump 110 not shown in FIG. 4). A first aperture 140 in the jet pump body 130 is proximate the uphole end 132. A seal portion 153 of the carrier 150 forms a seal with a carrier seat 144 when the carrier 150 is seated in the carrier seat 144. The carrier 150 includes a venturi 154 with a venturi nozzle 156 and a mixing tube 158 in series. A venturi gap 160 separates the venturi nozzle 156 from the mixing tube 158. The carrier 150 includes ports 157 for providing fluid communication with the venturi gap 160. An intake channel 161 is defined within the jet pump body 130 for providing fluid communication with the venturi 154. A housing 162 extends from the carrier 150. The housing 162 may receive a data tool 168 for acquiring data of downhole conditions. The data may for example include pressure data, temperature data, or both. The data tool 168 is isolated from conditions outside the housing 162, for example pressure and temperature resulting from flow of power fluid in the tubing 18. A power fluid inlet 164 in the carrier 150 provides fluid communication between the tubing 18 and the venturi 154. The power fluid inlet 164 provides fluid communication between the tubing 18 and the body 130 at an annulus 141 between the carrier body 152 and the carrier seat 144.

A power fluid channel 165 extends between the power fluid inlet 164 and the venturi nozzle 156. The power fluid channel 165 and the venturi 154 provide a flow path between the power fluid inlet 164 and the ports 157. A data inlet 167 in the carrier body 152 provides fluid communication with the housing 162. A data channel 169 extends between the data inlet 167 and the housing 162. Through the data channel 169, the data tool 168 may be exposed to downhole conditions by fluid communication with wellbore fluid, and receive data of downhole conditions. The power fluid channel 165 and data channel 169 are not in fluid communication within the carrier 150, allowing exposure of the data tool 168 to the downhole conditions, but not to conditions around the housing 162, for example due to flow of power fluid in the tubing 18.

Operation

In FIGS. 1 and 3, the jet pump 10 is producing fluid from the wellbore 12. In operation, power fluid 90 flows into the jet pump 10 from the tubing 18 via the power fluid inlet 64. The power fluid 90 flows from the power fluid inlet 64 into the venturi nozzle 56. While flowing through the venturi nozzle 56, the power fluid 90 flows across the venturi gap 60, creating a low-pressure condition at the venturi gap 60. The low-pressure condition causes wellbore fluid 92 to flow into the intake 36 and to the venturi gap 60. Upon entering the venturi gap 60 and the mixing tube 58, the wellbore fluid 92 combines with the power fluid 90, forming return fluid 94. The return fluid 94 flows out of the jet pump 10 at the second aperture 42 and into the annulus 20. The second aperture 42 functions as a return fluid outlet.

Without being bound by any theory, wellbore fluid 92 may flow into the data inlet 67, through the data channel 69, and to the housing 62. Flow of power fluid 92 through the venturi 54 may prevent power fluid 92 from flowing out of the venturi gap 60 and into the data inlet 67. Thus, conditions in the housing 62 reflect conditions of the wellbore fluid 92 and not of the power fluid 90 flowing through the tubing 18 and venturi 54. The low-pressure condition may prevent flow of wellbore fluid 92 to the housing 62 during production of return fluid 94. However, downhole conditions, for example pressure and temperature may be communicated through stationary wellbore fluid 92 within the data channel 69 and housing 62.

The data tool 68 may receive data when the jet pump 10 is not being operated to produce return fluid 94. Without being by any theory, in some cases, the standing valve 38 may close without flow of power fluid 90 through the venturi 54 to draw wellbore fluid 92 into the venturi gap 60. Where a hydrostatic fluid column is present in the tubing 18 uphole of the jet pump 10, the hydrostatic fluid column may prevent the standing valve 38 from opening to allow entry of wellbore fluid 92 and exposure of the data tool 68 to downhole conditions. To facilitate entry of wellbore fluid 92 into the jet pump 10 without producing return fluid 94, a low-density fluid may be pumped into the jet pump 10 to clear the tubing 18, jet pump body 30, and annulus 20, of power fluid 90, wellbore fluid 92, and return fluid 94. Once the low-density fluid has displaced the power fluid 90, wellbore fluid 92, and return fluid 94, from the tubing 18, jet pump body 30, and annulus 20, pumping of low-density fluid into the tubing 18 is ceased. The low-density fluid in the tubing 18, the jet pump body 30, and the annulus 20 may facilitate entry of wellbore fluid 92 into the intake 36 in the absence of the low-pressure condition.

The low-density fluid must have a lower density than the wellbore fluid 92. In an embodiment, the low-density fluid may be a gas, for example a non-condensible gas, for example nitrogen.

In an embodiment, the low-density fluid may be pumped into the tubing 18.

In an embodiment, the low-density fluid may be pumped into the annulus 20.

In an embodiment, the low-density fluid may be pumped into the tubing 18 and the annulus 20.

FIG. 5 is a cross-section elevation view of the jet pump 10 showing installation of the carrier 50. Power fluid 90 may flow past the centralizer 66 and push the carrier 50 at an accelerator shoulder 59 on the carrier body 52, propelling the carrier 50 into the jet pump body 30. The accelerator shoulder 59 provides a surface against which the power fluid 90 propels the carrier 50 for seating in the jet pump body 30. The carrier 50 enters the first aperture 40, and the carrier body 52 seats in the carrier seat 44. During production to produce return fluid 94, flow of the power fluid 90 urges the carrier 50 into the jet pump 10. The carrier 50 may thus be installed into the jet pump 10 without pulling the tubing 18 and the jet pump 10.

FIG. 6 is a cross-section elevation view of the jet pump 10 showing retrieval of the carrier 50. Flow to the jet pump 10 may be reversed relative to that of FIGS. 1 and 5 by flowing power fluid 90 into the annulus 20. The power fluid 90 enters the second aperture 42 and flows into the mixing tube 58, unseating the carrier 50 from the carrier seat 44 and propelling the carrier 50 into the tubing 18. The mixing tube 58 provides a surface against which the power fluid 90 propels the carrier 50 for retrieving the carrier 50 from the jet pump body 30. The carrier 50 may be retrieved at the surface. The carrier 50 may be reinstalled into the jet pump 10 by introducing it into the tubing 18 and flowing power fluid 90 into the tubing 90. The carrier 50 may thus be retrieved from, and reinstalled into, the jet pump 10, without pulling the tubing 18 and the jet pump 10.

The data tool 68 may receive data of downhole conditions, for example temperature and pressure. The data tool 68 may receive data while the jet pump 10 is producing return fluid 94 and while it is not producing return fluid 94. When desired, the carrier 50 may be circulated to the surface, the data accessed, and the carrier 50 reinstalled in the jet pump 10. After installation of the carrier 50, operation of the jet pump 10 may be resumed by flowing power fluid 90 into the tubing 18. The above steps can each be completed without pulling the tubing 18.

Segregation of Data Tool Housing from Wellbore Fluid

Figure 7:
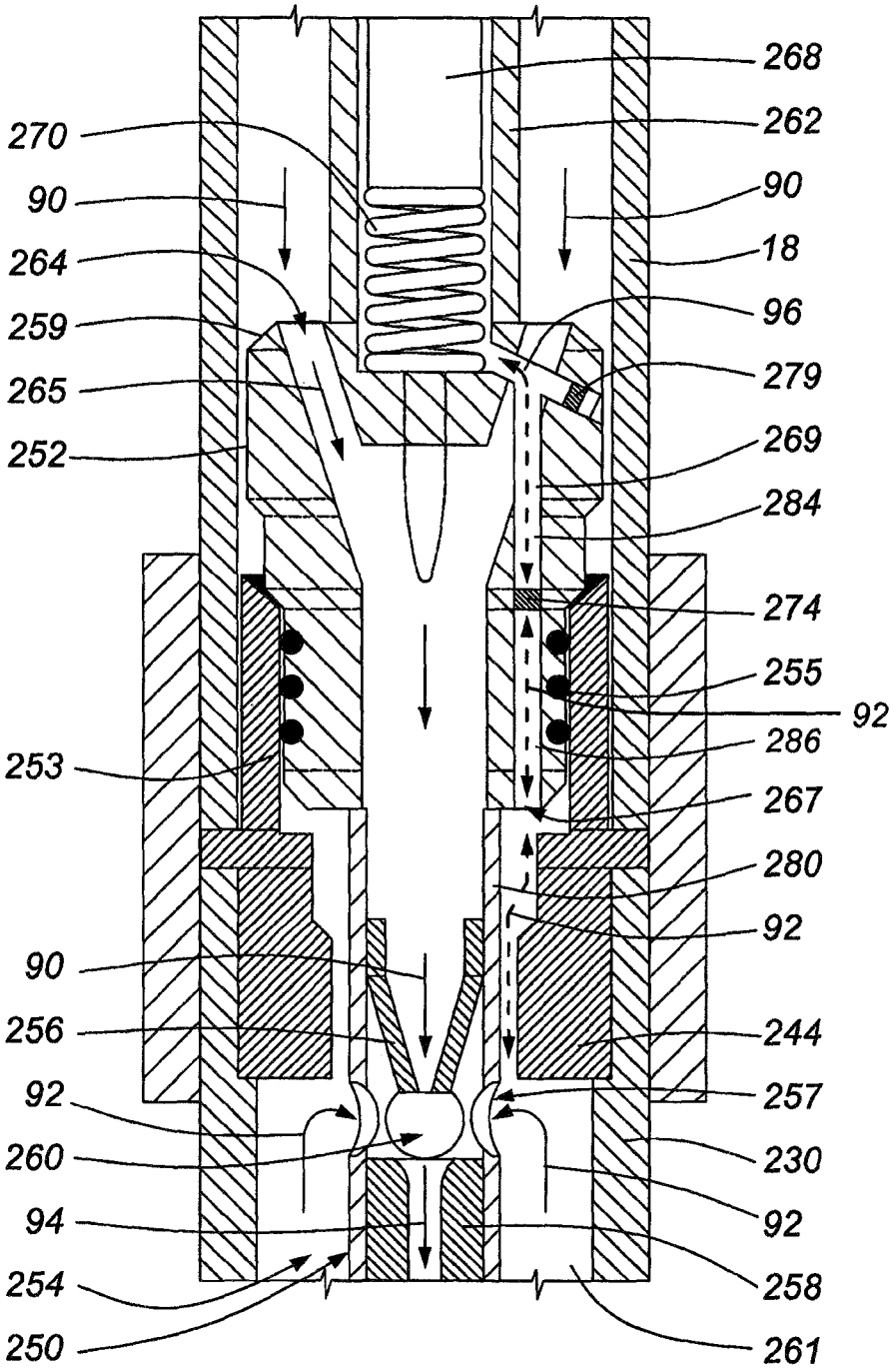
FIG. 7 is a cross-section elevation view of a carrier seated in a jet pump.

FIG. 7 is a cross-section elevation view of a carrier 250 seated in a carrier seat 244 of a jet pump body 230. A seal portion 253 of the carrier 250 forms a seal with the carrier seat 244 when the carrier 250 is seated in the carrier seat 244. The seal portion 253 may include one or more o-rings 255. The carrier 250 includes a venturi 254 with a venturi nozzle 256 and a mixing tube 258 in series. A venturi gap 260 separates the venturi nozzle 256 from the mixing tube 258. The carrier 250 includes ports 257 for providing fluid communication with the venturi gap 260. An intake channel 261 is defined within the jet pump body 230 for providing fluid communication with the venturi 254. A power fluid channel 265 extends between the power fluid inlet 264 and the venturi nozzle 256. The power fluid channel 265 and the venturi 254 provide a flow path between the power fluid inlet 264 and the ports 257. A data inlet 267 in the carrier body 252 provides fluid communication with the housing 262. The carrier 250 includes a fluid segregation membrane 274 in the data channel 269 of the carrier body 252. The fluid segregation membrane 274 divides the data channel 269 into a first portion 284 and a second portion 286. The first portion 284 is in fluid communication with the housing 262. Data fluid 96 may be present in the first portion 284 and in the housing 262. The data fluid 96 may for example be an oil. The second portion 286 is in fluid communication with an intake of the jet pump 210 (intake not shown). The wellbore fluid 92 may be present in the second portion 286.

The fluid segregation membrane 274 prevents the wellbore fluid 92 from entering the housing 262 but allows data to be communicated to the data tool 268 through data fluid 275 located in the housing 262. The data may thus be received by the data tool 268 without exposing the data tool 268 directly to the wellbore fluid 92.

In an embodiment, the fluid segregation membrane 274 may an elastomeric membrane, such as a rubber membrane.

Carrier and Wireline Real Time Sensing Tool Assembly

Figure 8:
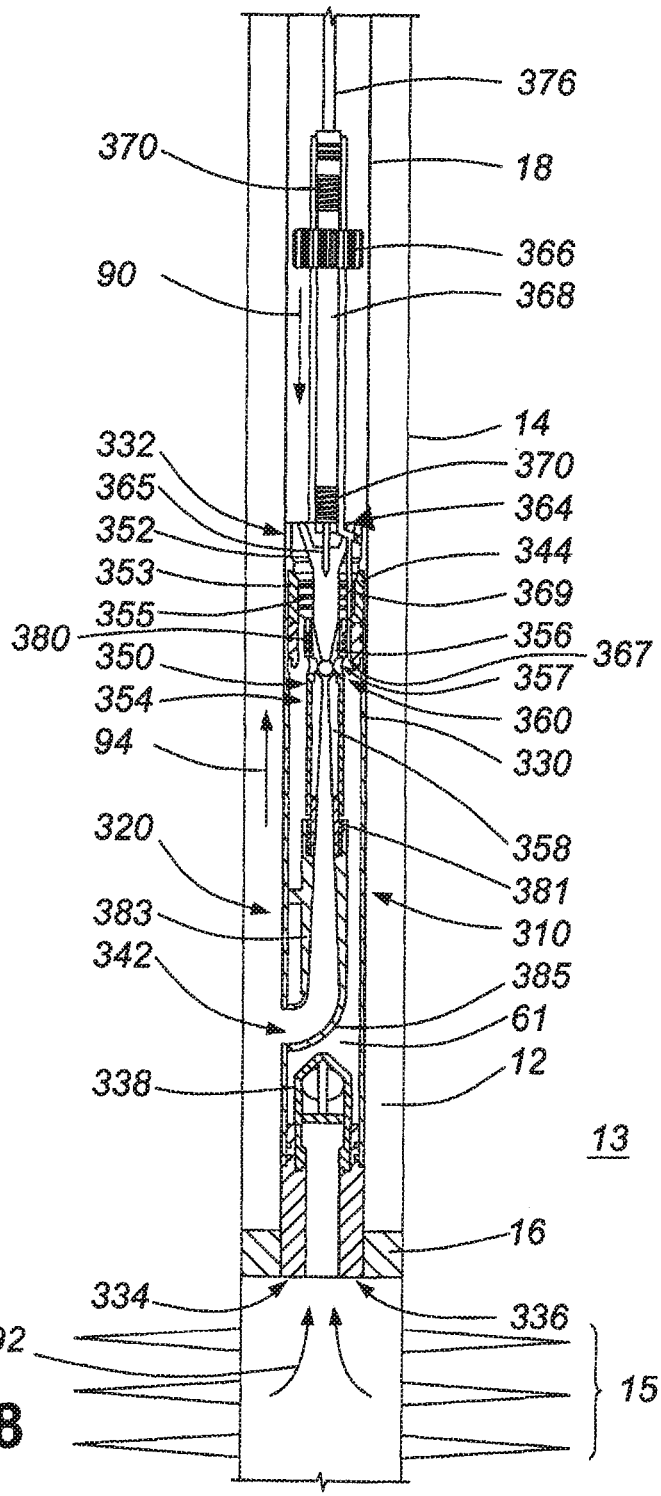
FIG. 8 is a cross-section elevation view of a jet pump with a carrier in a wellbore and producing fluid.

FIG. 8 is a cross-section of a jet pump 310 in a wellbore 12 and in operation. The wellbore 12 is in a formation 13 with perforations 15. The wellbore 12 includes a casing 14. The jet pump 10 is secured to the casing 14 by a packer 16. The jet pump 10 is in fluid communication with the surface through tubing 18 and through an annulus 20 defined by the tubing 18 and the casing 14. The jet pump 310 includes a jet pump body 330 with an uphole end 332 and a downhole end 334. When the jet pump 310 is installed on the tubing 18 in the wellbore 12, the uphole end 332 is uphole of the downhole end 334 in both horizontal and vertical wellbores. An intake 336 in the jet pump body 330 is proximate the downhole end 334. The intake 336 provides fluid communication between the wellbore 312 and the jet pump body 330. The jet pump body 330 may include a standing valve 338. A first aperture in the jet pump body 330 is proximate the uphole end 332. A seal portion 353 of the carrier 350 forms a seal with a carrier seat 344 when the carrier 350 is seated in the carrier seat 344. The seal portion 353 may include one or more o-rings 355.

The carrier 350 includes a venturi 354 with a venturi nozzle 356 and a mixing tube 358 in series. A venturi gap 360 separates the venturi nozzle 356 from the mixing tube 358. The carrier 350 includes ports 357 for providing fluid communication with the venturi gap 360. An intake channel 361 is defined within the jet pump body 330 for providing fluid communication with the venturi 354. A housing 362 extends from the carrier 350. The housing 362 may receive a data tool 368 for acquiring data of downhole conditions. The data may for example include pressure data, temperature data, or both. The data tool 368 is isolated from conditions outside the housing 362, for example pressure and temperature resulting from flow of power fluid in the tubing 18. A power fluid inlet 364 in the carrier 350 provides fluid communication between the tubing 18 and the venturi 354. A power fluid channel 365 extends between the power fluid inlet 364 and the venturi nozzle 356. The power fluid channel 365 and the venturi 354 provide a flow path between the power fluid inlet 364 and the ports 357. A data inlet 367 in the carrier body 352 provides fluid communication with the housing 362. A data channel 369 extends between the data inlet 367 and the housing 362. Through the data channel 369, the data tool 368 may be exposed to downhole conditions by fluid communication with wellbore fluid, and receive data of downhole conditions. The power fluid channel 365 and data channel 369 are not in fluid communication within the carrier 350, allowing exposure of the data tool 368 to the downhole conditions, but not to conditions around the housing 362, for example due to flow of power fluid in the tubing 18.

Figure 9:
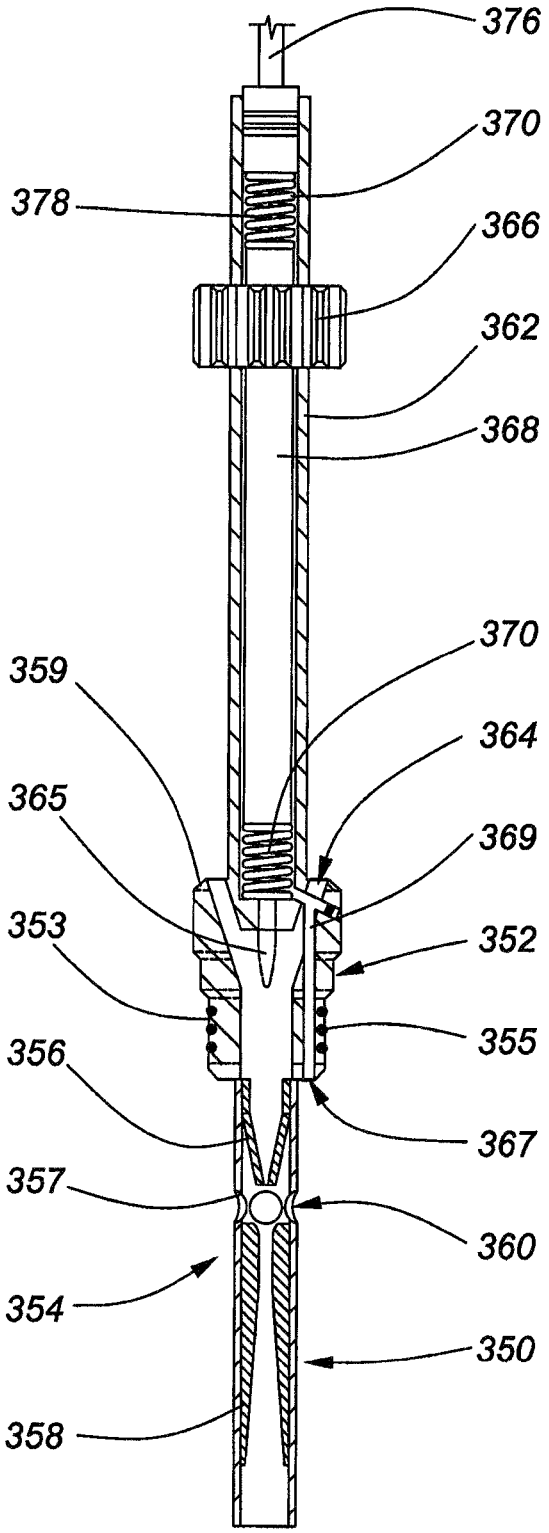
FIG. 9 is a cross-section elevation view of the carrier of FIG. 8.

FIG. 9 is a cross-section of a carrier 350 for use in the jet pump 310. The data tool 368 is in operative communication with the surface through a wire 378. The wire 378 is enclosed in a protective sheath 376. Power fluid may flow past the centralizer 366 and push the carrier 350 at an accelerator shoulder 359 on the carrier body 352, propelling the carrier 350 into the jet pump body 330. The accelerator shoulder 359 provides a surface against which the power fluid propels the carrier 350 for seating in the jet pump body 330. The carrier 350 enters the first aperture 340, and the carrier body 352 seats in the carrier seat 344. During production to produce return fluid, flow of the power fluid urges the carrier 350 into the jet pump 310. The carrier 350 may thus be installed into the jet pump 310 without pulling the tubing 18 and the jet pump 310.

In an embodiment, an uphole nut 380 is located on the carrier 350 uphole of the venturi nozzle 356 and a downhole nut 381 is located downhole of the mixing tube 358. The geometry of the venturi nozzle 358 and the uphole nut 380 may be selected to allow selected performance parameters of the jet pump 310. The venturi nozzle 356 and the uphole nut 380 may be removable and exchangeable with one or more additional venturi nozzles or uphole nuts to adjust performance of the jet pump 310. The geometry of the mixing tube 358 and downhole nut 381 may be selected to allow selected performance parameters of the jet pump 310. The mixing tube 358 and downhole nut 381 may be removable and exchangeable with one or more additional mixing tubes or downhole nuts to adjust performance of the jet pump 310. The downhole nut 381 may include a hardened material or include a hardened coating to increase resistance to erosion. The diffuser 383 may receive the downhole nut 381. The diffuser 383 may be in fluid communication with the second aperture 342 through a diffuser elbow 385. The diffuser elbow 385 may be within the intake channel 361.

In an embodiment, the data tool 368 may be a real-time data sensing tool for providing data to the surface in real time through the wire 378.

In an embodiment, a fishing neck may also be present on the carrier 350 to facilitate removal of the carrier 350 from the tubing 18 after retrieval at a wellhead.

In an embodiment, the wire 378 runs through the uphole spring 370.

Changing Venturi Components

In an embodiment, an uphole nut 80 is located on the carrier 50 uphole of the venturi nozzle 56 and a downhole nut 81 is located downhole of the mixing tube 58.

The geometry of the venturi nozzle 58 and the uphole nut 80 may be selected to allow selected performance parameters of the jet pump 10. The venturi nozzle 56 and the uphole nut 80 may be removable and exchangeable with one or more additional venturi nozzles or uphole nuts to adjust performance of the jet pump 10.

The geometry of the mixing tube 58 and downhole nut 81 may be selected to allow selected performance parameters of the jet pump 10. The mixing tube 58 and downhole nut 81 may be removable and exchangeable with one or more additional mixing tubes or downhole nuts to adjust performance of the jet pump 10. The downhole nut 81 may include a hardened material or include a hardened coating to increase resistance to erosion. The diffuser 83 may receive the downhole nut 81. The diffuser 83 may be in fluid communication with the second aperture 42 through a diffuser elbow 85. The diffuser elbow 85 may be within the intake channel 61.

During operation, the carrier 50 may be circulated out of the jet pump 10 and retrieved at the surface. The venturi nozzle 56 or mixing tube 58 may be removed and replaced with a different venturi nozzle or mixing tube. The carrier 50 may then be circulated back into the jet pump 10 for use with the different venturi nozzle or mixing tube. This may facilitate production during changing conditions, or may facilitated changeout of worn out components of the venturi 54.

Examples Only

In the preceding description, for purposes of explanation, numerous details are set forth in order to provide a thorough understanding of the embodiments. However, it will be apparent to one skilled in the art that these specific details are not required. In other instances, well-known electrical structures and circuits are shown in block diagram form in order not to obscure the understanding. For example, specific details are not provided as to whether the embodiments described herein are implemented as a software routine, hardware circuit, firmware, or a combination thereof.

The figures provided herein illustrate use of a carrier with jet pumps having concentric conduits for provision of power fluid and production of return fluid. However, the carrier disclosed herein may also be used with other jet pumps, for example a jet pump with side-by-side tubings for provision of power fluid and production of return fluid as disclosed in U.S. publication no. US 2010/0230107 by Falk et al.

The above-described embodiments are intended to be examples only. Alterations, modifications and variations can be effected to the particular embodiments by those of skill in the art without departing from the scope, which is defined solely by the claims appended hereto.

What is claimed is:

1. A jet pump comprising:

a body having an uphole end and a downhole end, the body comprising:

an intake proximate the downhole end;

a first aperture proximate the uphole end;

a second aperture between the first aperture and the intake; and an intake channel in fluid communication with the intake;

a carrier seated in the body and receivable in the first aperture, the carrier comprising:

a power fluid inlet;

a flow path providing fluid communication between the power fluid inlet and the second aperture; and a venturi within the flow path, the venturi in fluid communication with the intake, the intake channel, the power fluid inlet, and the second aperture, configured to draw wellbore fluid from the intake into the venturi when power fluid flows from the power fluid inlet to the second aperture and through the venturi; and a housing extending from the carrier proximate the uphole end and configured to receive a data tool;

wherein:

the carrier comprises a data channel configured to provide fluid communication between the intake and the housing when power fluid flows from the power fluid inlet toward the second aperture and through the venturi;

the carrier is seatable in the body by flowing power fluid and the carrier into the first aperture; and the carrier is retrievable from the body by flowing power fluid into the second aperture.

2. The jet pump of claim 1 further comprising an accelerator shoulder on the carrier configured to provide a surface against which the power fluid propels the carrier configured to seat in the body.

3. The jet pump of claim 1 further comprising a mixing tube downstream of the venturi and wherein the mixing tube provides a surface against which the power fluid propels the carrier configured to retrieve the carrier from the body.

4. The jet pump of claim 1 wherein the data channel is in fluid communication with the intake channel when the power fluid flows from the power fluid intake toward the second aperture and through the venturi.

5. The jet pump of claim 4 wherein the data channel branches from the intake channel between the venturi and the first aperture.

6. The jet pump of claim 5 wherein the housing extends from the carrier out of the uphole end.

7. The jet pump of claim 6 wherein the housing extends into tubing when the jet pump is in fluid communication with the tubing.

8. The jet pump of claim 1 further comprising a fluid segregation membrane dividing the data channel into a first portion and a second portion, wherein the first portion is in fluid communication with the housing and the second portion is in fluid communication with the intake.

9. The jet pump of claim 8 further comprising data fluid in the first portion and in the housing.

10. The jet pump of claim 1 further comprising a housed data tool in the housing configured to acquire data of downhole conditions.

11. The jet pump of claim 10 wherein the housed data tool comprises a memory tool.

12. The jet pump of claim 11 wherein the memory tool comprises memory configured to store data, a processor in operative communication with the memory configured to cause the data to be stored on the memory, and a power source configured to provide power to the processor and memory.

13. The jet pump of claim 10 further comprising a wired connection between the housed data tool and the surface configured to establish operative communication between the data tool and the surface.

14. The jet pump of claim 13 wherein the housed data tool comprises a real-time data sensing tool.

* * * * *